US005087798A

United States Patent [19]

Rohde et al.

[11] Patent Number: 5,087,798

[45] Date of Patent: Feb. 11, 1992

[54] ILLUMINATED ELASTOMERIC ROCKER SWITCH ASSEMBLY

[75] Inventors: Mark W. Rohde, Scio; George T. Kirkwood, Hillsboro; Dick G. Schalk, Portland, all of Oreg.

[73] Assignee: Rodgers Instrument Corporation, Hillsboro, Oreg.

[21] Appl. No.: 494,147

[22] Filed: Mar. 14, 1990

[51] Int. Cl.[5] ..... H01H 13/70; H01H 9/00

[52] U.S. Cl. ..... 200/5 A; 200/517; 200/315; 200/339

[58] Field of Search ..... 200/5 R, 5 A, 6 A, 512, 200/513, 517, 315, 339

[56] References Cited

U.S. PATENT DOCUMENTS

| | | | |
|---|---|---|---|
| 4,005,293 | 1/1977 | Boulanger | 200/5 A |
| 4,127,752 | 11/1978 | Lowthrop | 200/5 A |
| 4,246,452 | 1/1981 | Chandler | 200/5 A |
| 4,376,238 | 3/1983 | Martin | 200/5 A X |
| 4,441,001 | 4/1984 | Miyano et al. | 200/308 |
| 4,490,587 | 12/1984 | Miller et al. | 200/5 A |
| 4,499,342 | 2/1985 | Nakayama | 200/5 A X |
| 4,618,744 | 10/1986 | Pope et al. | 200/5 A |
| 4,654,488 | 3/1987 | Westfall | 200/339 X |
| 4,668,843 | 5/1987 | Watanabe et al. | 200/5 A |
| 4,687,200 | 8/1987 | Shirai | 200/339 X |
| 4,710,602 | 12/1987 | Baity et al. | 200/315 |
| 4,839,474 | 6/1989 | Hayes-Pankhurst et al. | 200/5 A |
| 4,918,264 | 4/1990 | Yamamoto et al. | 200/517 X |
| 4,929,804 | 5/1990 | Kawai et al. | 200/339 X |

FOREIGN PATENT DOCUMENTS

| | | | |
|---|---|---|---|
| 1082815 | 6/1960 | Fed. Rep. of Germany | 200/339 |
| 2087154 | 5/1982 | United Kingdom | 200/339 |

*Primary Examiner*—J. R. Scott
*Attorney, Agent, or Firm*—William A. Birdwell

[57] ABSTRACT

A rocker switch, particularly for selecting voices in an electronic organ. A translucent tab is pivotally mounted at its center on a printed circuit board such that when the tab is pressed at either end, it actuates a respective elastomeric electric switch also mounted on the printed circuit board. A lamp is releasably mounted on the printed circuit board through an aperture in the back thereof by a twist-lock mechanism. A petal-like reflector and shield is disposed behind the tab for reflecting light from the lamp through the tab while blocking stray light and minimizing heat buildup. Elastomeric electric switches are positioned on the circuit board by pins and held in place by the pressure of the petal-like reflector, which is attached to the circuit board by plastic rivets. The tabs snap onto pivot points integrally formed as part of a rocker bar that includes the petal-like reflector.

24 Claims, 2 Drawing Sheets

ILLUMINATED ELASTOMERIC ROCKER SWITCH ASSEMBLY

BACKGROUND OF THE INVENTION

This invention relates to electrical switches, particularly rocker switches.

Electronic organs conventionally employ rocker switches for selecting voices to be played by the musician. Rocker switches comprise a pivoted tab which is pressed inwardly to select or deselect a voice. Typically, the tab is pivoted at the middle so that it is pressed at one end to select the voice and at the other end to deselect the voice. Such rocker switches are ordinarily illuminated by a lamp behind the tab so that when a voice is selected the lamp turns on and when the voice is deselected the lamp turns off.

Such conventional rocker switches have a number of drawbacks. First, heat generated by the lamps is captured beneath the switches, which causes undesirably rapid deterioration of the parts. Such conventional rocker switches are also relatively complex, involving many parts, so that they require considerable effort to assemble and install. In that regard, replacement of a burnt out lamp ordinarily requires unsoldering of the rocker switch from its circuit and complete removal of the rocker switch in order to replace the lamp. In addition, the life of conventional rocker switches is limited to about 100,000 cycles, which is far less than the useful life of a typical electronic organ.

Accordingly, there is a need for improvements in the heat dissipation, ease of assembly and repair, and useful life of rocker switches, particularly those for use in electronic organs.

SUMMARY OF THE INVENTION

The present invention meets the aforementioned needs by providing a rocker switch illuminated by a lamp, wherein a petal-like reflector and shield directs the majority of the illumination from a lamp through the tab while providing increased air circulation to reduce heat buildup, snap-together construction is employed for ease of assembly and repair, and elastomeric electric switches are used in combination with the tab to provide a useful life on the order of three million cycles.

A translucent tab is pivotally mounted on a base such that when the tab is pressed it actuates an elastomeric electric switch also mounted on the base. Preferably, the tab is pivoted at the center thereof. A lamp is releasably mounted through an aperture in the back of the base by a twist-lock mechanism. The petal-like reflector and shield is disposed behind the tab for reflecting light from the lamp through the tab, while blocking light from illuminating the next adjacent rocker switch or otherwise escaping in an undesirable direction.

The tabs include sides perpendicular to the face of the tab which press down elastomeric electric switches when the tab is pushed. The elastomeric electric switches are offset from the center of the tab, beneath the side of the tab, so as to provide room for the petal-like reflector. The elastomeric electric switches provide the resiliency for the tab to return to its normal position. Elastomeric stops are provided to prevent the tab from traveling too far.

A plurality of rocker switches are mounted side-by-side. The elastomeric electric switches are formed out of a continuous strip of material that fits onto a printed circuit board in a position determined by guide pins and held in place by the pressure of the petal-like reflector and shield. The reflector and shield and pivot points for the tabs are made of unitary construction and mounted on the circuit board by plastic rivets. The tabs snap onto the pivot points.

Accordingly, it is a principal objective of the present invention to provide a novel and improved rocker switch.

It is another objective of the present invention to provide such a rocker switch that includes a lamp for illuminating the rocker switch, but minimizes heat buildup from the lamp.

It is yet another objective of the present invention to provide such a rocker switch which can be readily assembled and disassembled for installation and repair.

It is a further objective of the present invention to provide such a rocker switch which has an increased useful life.

It is a principal feature of the present invention that it employs a petal-like combination light reflector and shield behind a rocker switch tab to direct through the tab, light from a lamp, also behind the tab, prevent stray light from escaping, and minimize heat buildup.

It is another feature of the present invention that it employs snap-together construction for ease of assembly, disassembly, and repair.

It is a further feature of the present invention that it employs a novel combination of pivoted tab and elastomeric electric switch to achieve extended useful life.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 2:
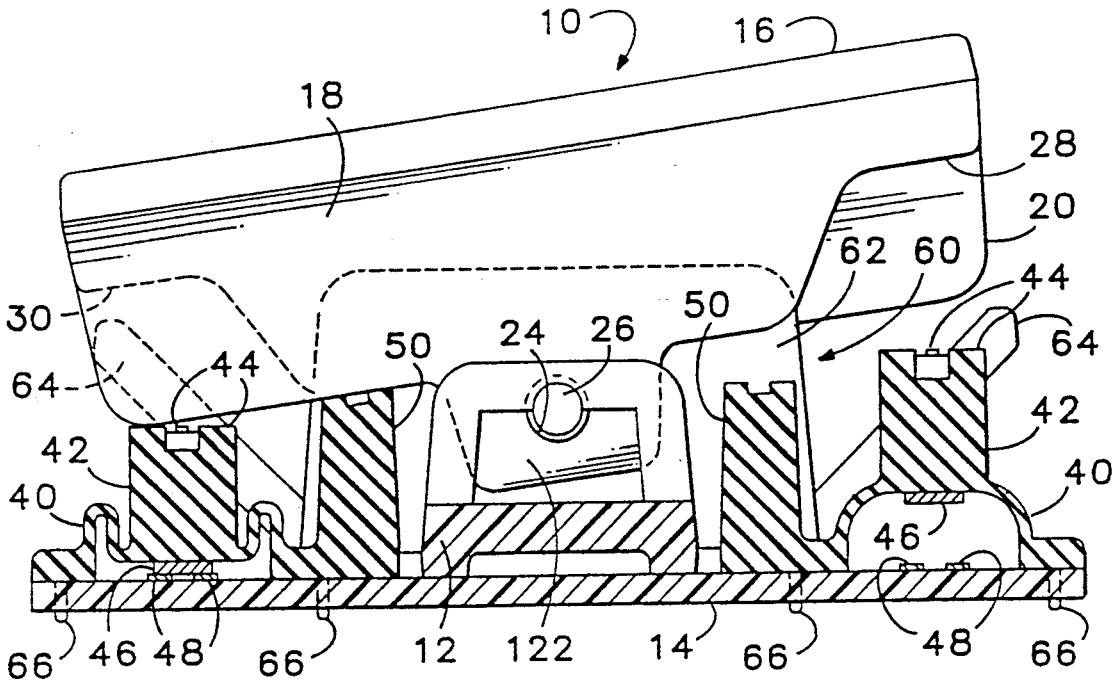
FIG. 2 shows a side view of a rocker switch according to the present invention, taken along line A—A of FIG. 1, except that the tab is depressed at one end, the tab is not cut away, and the second switch is not shown.

Referring first to FIG. 2, the preferred embodiment of a rocker switch according to the present invention comprises a tab 10 pivotally mounted on a rocker bar 12, disposed on a circuit board 14, which provides the base for the rocker switch. The tab has a C-shaped cross section, including a face 16, a first side 18 (foreground) that is perpendicular to the face 16 and a second side 20 (background) that is also perpendicular to the face. Both the first and the second sides have a downward extension 22 which includes a bearing aperture 24 by which the tab is pivoted. Each downward extension 22 snaps onto the rocker bar 12, and each bearing aperture receives a respective pivot point 26 having a circular cross section and acting as a bearing for the pivoting of the tab. Each pivot point is part of the rocker bar 12, as shown in FIG. 3.

The first side 18, includes a first recessed portion 28 at one end of the tab on the first side 18, and a second recessed portion 30 at the other end of the tab on the second side 20. These recessed portions permit the tab to clear switches associated with an adjacent tab, as will be explained hereafter. As the tab is symmetrical in shape, it can be installed in either direction and still work. Preferably, the tab is made of plastic, or some equivalent material, that is translucent so that light behind the tab can evenly illuminate the front of the tab. Also preferably, the tab is pivoted at its center so that it can rock in either of two directions, as shown in the drawings, but it is to be understood that other configurations, such as a tab pivoted so as to tip in only one direction, might be made without departing from the principles of this invention.

Figure 1:
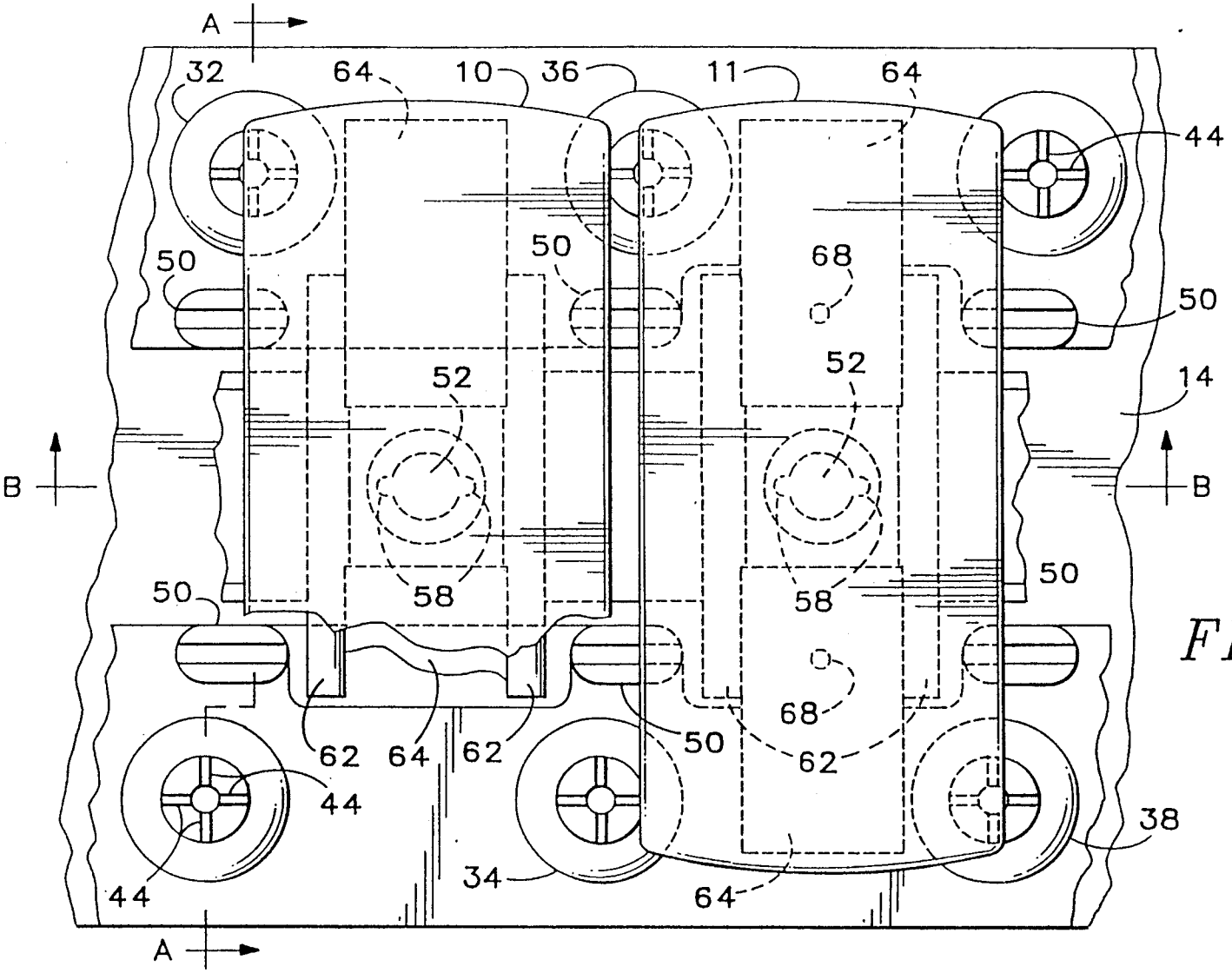
FIG. 1 shows a top view of a pair of adjacent rocker switches according to the present invention, with one of those rocker switches partially cut away.
Figure 3:
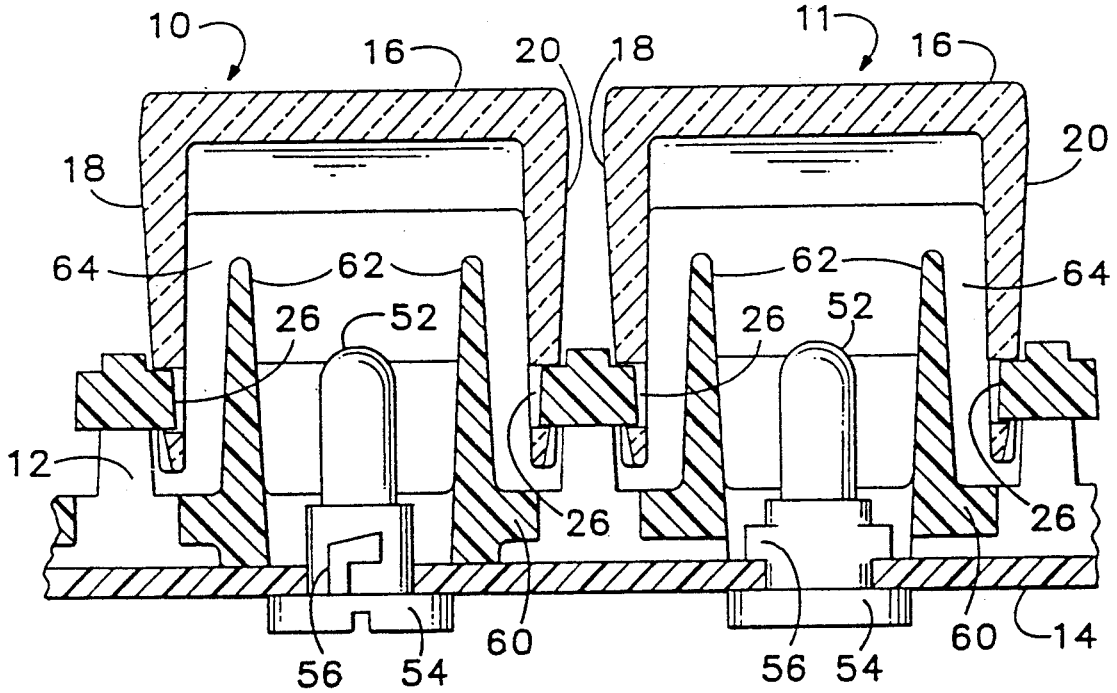
FIG. 3 shows an end, section view of the pair of rocker switches of FIG. 2 taken along line B—B thereof.

Turning to FIG. 1, two rocker switches are shown side by side, one on the left and one on the right, as in FIG. 3 as well. Each rocker switch has a respective tab, tab 10 on the left and tab 11 on the right. In the preferred embodiment each tab has two elastomeric electric switches associated with it. There is an "off" elastomeric electric switch 32 placed at the upper end of the tab 10 on the left so that when that end of the tab is pressed the switch will be actuated, and an "on" elastomeric electric switch 34 placed at the lower end of the tab 10 so that when that other end of the tab is pressed the "on" switch will be actuated. Each switch is actuated by the corresponding side 18 or 20 of the tab. Thence, with respect to the tab 10 on the left in FIG. 2, the "off" switch 32 is actuated by side 20 of that tab and the "on" switch 34 is actuated by side 18 of that tab. Likewise, an "off" switch 36 is actuated by side 20 of the tab 11 and an "on" switch 38 is actuated by side 18 of the tab 11. In order to pack the tabs as closely beside one another as possible, the recessed portions 28 and 30 are provided so that the sides 18 and 20, respectively, of one tab do not actuate the "on" and "off" switches of an adjacent tab.

The construction of the elastomeric electric switches, and their relationship between the sides of each tab, is best shown in FIG. 2. Each elastomeric electric switch comprises a chamber formed by a domed wall 40 having an abutment 42 at the top thereof. Fins 44, having space therebetween, are disposed at the top of the abutment 42 for receiving a side of the tab. The space allows air to escape and not be trapped between the side of the tab and the abutment, which might otherwise produce noise. A conductive element 46 is disposed in the chamber at the top of the domed wall. The conductive element preferably is made of graphite impregnated rubber ("conductive rubber"). A pair of contacts 48 is pasted or etched onto the circuit board 14 so that when the conductive element 46 is pressed against the circuit board, it shorts those contacts and makes a circuit, as shown at the lefthand side of FIG. 2. The elastomeric electric switches themselves are preferably made of a resilient, rubber material. The air pressure within the chamber of the elastomeric electric switch, as well as the resiliency of the material with which it is made, provides spring force for returning the tab to its normal position.

Adjacent each elastomeric electric switch is a stop 50 which limits the downward travel of the tab. As shown in FIG. 1, each stop 50 can serve a pair of adjacent tabs, as the stops are not beneath the recessed portions 28 and 30. The stops are preferably made of the same elastomeric material as the elastomeric electric switches. Preferably a series of electric switches and stops are molded side-by-side out of the same elastomeric material, forming a strip that can be disposed at the top or bottom of a corresponding series of rocker switches when assembled.

A lamp 52 is mounted on the circuit board 14 behind each tab 10. The lamp is of a type used in the automobile industry that snaps into an aperture when inserted in the aperture and twisted. This result is provided by the twist-lock lamp base 54, as shown in FIG. 3. The lamp on the left side has been inserted, but not twisted so as to lock in place. The lamp on the right side has been twisted so as to lock in place. It can be seen that the base has hooks 56 on each side which catch the circuit board when the base is twisted. This requires that the aperture for the lamp includes slots 58 for receiving the hooks, as shown in FIG. 1.

A petal-like light reflector 60 is disposed beneath each tab. The reflector also acts as a light sheild. Each reflector includes two different kinds of reflector elements, or "petals." First, each reflector includes a pair of side elements, or "petals" 62, substatially perpendicular to the circuit board 14 and straddling the corresponding lamp 52. Each reflector 60 also includes a pair of end elements, or "petals" 64 which sraddle the lamp 52 and extend upwardly from the circuit board 14 toward the respective ends of the tab 10. These end elements form a substantailly 45°angle with the circuit board so that light from the lamp strikes them and is reflected outwardly through the face 16 of the tab and provides even lighting of the tab so that it does not have a spot in the middle. The side elements 62 and 64 also act as sheilds to prevent light from escaping other than through the face 16 of the tab, so that stray light does not illuminate an adjacent tab or otherwise escape to areas where it is not wanted.

The parts of the rocker switch are made so that they snap together. As has already been explained, the lamps snap into place in response to insertion in an aperture in the circuit board 14 twisting. The tabs 16 snap over the pivot points 26, as shown in FIG. 3. They can be removed by squeezing in on the ides 18 and 20 so as to clear the edges of the pivot points 26. The elastomeric electric switches and bumpers 50 are made of a molded rubber plastic strip with pins 66 which fit in holes in the circuit board 14, as shown in FIG. 1. The reflectors 60 are molded together with the rocker bar 12 as a complete unit, which is attached to the circuit board by plastic rivets 68 of a commonly known type, that snap in place, though other appropriate fasteners could be employed without departing from the principle of the invention. Portions of the elastomeric electric switch strips are sandwiched between the circuit board 14 and the rocker bar 12, so that they are held in place by pressure from the rocker bar.

Preferably, the rocker switches would come in a strip of a plurality of switches. The end of the strip includes half of another switch so that when one strip of rocker switches is abutted against another, an extra rocker switch is produced.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A rocker switch assembly, comprising:

(a) base means for supporting a plurality of electric switches;

(b) a plurality of tabs made of a material that allows light to pass therethrough, each tab having a C-shaped cross section forming a face and sides thereof, the sides being substantially perpendicular to the face, each tab being mounted on said base means by its sides at a pivot point such that said tab pivots on an axis which is substantially perpendicular to the sides thereof;

(c) a lamp mounted on said base means by releasable means for inserting said lamp through an aperture in said base means from the side thereof opposite said tab, said lamp being disposed between the sides of its corresponding tab;

(d) a plurality of reflector means mounted on said base means, each reflector means being disposed substantially centrally between the sides of a corresponding tab for directing light from said lamp through the face of said tab; and (e) a plurality of elastomeric electric switches mounted adjacent one another on said base means, each said elastomeric electric switch being disposed beneath one side of one of said tabs so as to be activated by said one side when tab is pivoted, the other side of said tab being recessed so as not to activate an adjacent elastomeric switch when said tab is pivoted, thereby enabling said tabs and said elastomeric switches to be closely packed side by side without said tabs activating elastomeric switches of adjacent tabs.

2. The rocker switch assembly of claim 1, further comprising stop means mounted on said base means between said tab and said base means for limiting the travel of said tab toward said base means, each said stop means being positioned to limit the travel of two adjacent tabs.

3. A rocker switch assembly, comprising:

(a) base means for supporting a plurality of electric switches;

(b) a plurality of tabs made of a material that allows light to pass therethrough, said tabs being pivotally mounted side-by-side on said base means at respective pivot points disposed at their respective midpoints;

(c) a plurality of elastomeric electric switches, each being mounted on said base beneath a corresponding tab at a position between said base means and said corresponding tab and offset from said pivot point of said corresponding tab;

(d) a plurality of lamps each being mounted on said base means beneath a corresponding tab and disposed between said tab and said base means;

(e) a plurality of reflector means mounted on said base means, each reflector means being disposed between a corresponding tab and said base means for directing light from said lamp through said tab, said reflector means comprising a first pair of reflective elements disposed substantially perpendicular to said base means between said corresponding tab and said base means and bracketing said lamp so as to substantially prevent light from said lamp from passing through an adjacent tab, and a second pair of reflective elements extending from respective positions adjacent said base means and inset from respective ends of said tab, thereby forming an acute angle with said base means so as to direct light upwardly through said tab.

4. The rocker switch assembly of claim 3, wherein said lamp is mounted on said base means by releasable means for inserting said lamp through an aperture in said base means from the side thereof opposite said tab.

5. A rocker switch assembly, comprising:

(a) base means for supporting a plurality of electric switches;

(b) a plurality of tabs made of a material that allows light to pass therethrough, said tabs being disposed side-by-side;

(c) pivot means for mounting said tabs on said base means such that said tabs pivot toward and away from said base means;

(d) a plurality of lamps each being mounted on said base means beneath a corresponding tab and disposed between said tab and said base means;

(e) a plurality of petal-like reflectors corresponding to said tabs and mounted on said base means, each said reflector being disposed around the lamp corresponding to a respective tab so as to reflect light form said lamp through said tab, said pivot means and said reflectors being molded as a single piece; and (f) a plurality of elastomeric electric switches corresponding to said tabs molded together in a strip sandwiched between said base means and said single piece forming said pivot means and said reflectors, said single piece being attached to said base means by fasteners, each said switch being disposed at a position between a respective tab and said base means and offset from said pivot means of said respective tab.

6. A rocker switch, comprising:

(a) base means for supporting a momentary electrical contact switch;

(b) a tab made of a material that allows light to pass therethrough;

(c) pivot means for mounting said tab on said base means such that said tab pivots toward and away from said base means;

(d) a momentary electrical contact switch mounted on said base means at a position between said tab and said base means and offset from said pivot means so as to be actuated by said tab when said tab pivots toward said switch;

(e) a lamp mounted on said base means beneath said tab and disposed between said tab and said base means; and (f) reflector means beneath said tab and disposed between said tab and said base means for directing light from said lamp through said tab.

7. The rocker switch of claim 6 wherein said lamp is mounted on said base means by releasable means for inserting said lamp through an aperture in said base means from the side thereof opposite said tab.

8. The rocker switch of claim 6, wherein said reflector means is mounted on said base means substantially centrally of said tab between said tab and said base means and said momentary electrical contact switch is disposed adjacent one side of said reflector means.

9. The rocker switch of claim 6, wherein said momentary electrical contact switch is an elastomeric electric switch made of resilient material, said tab being caused to return to a normal position by said elastomeric electric switch.

10. The rocker switch of claim 6, further comprising stop means mounted on said base means between said tab and said base means for limiting the travel of said tab toward said base means.

11. The rocker switch of claim 6, wherein said pivot means is disposed at the midpoint of said tab, said rocker switch includes two momentary electrical contact switches, said switches each being an elastomeric electric switch and being disposed between said base means and those opposing ends of said tab which move toward and away from said base means when said tab is pivoted.

12. The rocker switch of claim 1, wherein said reflector means comprises reflective elements extending from respective positions adjacent said base means and inset from respective ends of said tab toward respective positions closer to respective ends of said tab, and rising above said base means, thereby forming an acute angle with said base means.

13. The rocker switch of claim 6, wherein said reflector means comprises petal-like reflective elements.

14. The rocker switch of claim 6, wherein said pivot means and said reflector means are molded as a single piece.

15. The rocker switch of claim 6 wherein said pivot means and said reflector means are attached to said base means by fasteners.

16. An rocker switches assembly, comprising:

(a) base means for supporting an electric switch;

(b) a plurality of tabs, each tab having a C-shaped cross section forming a face and sides thereof, the sides being substantially perpendicular to the face, each tab being mounted on said base means by its sides at a pivot point such that said tab pivots on an axis which is substantially perpendicular to the sides thereof; and (c) a first plurality of electric switches mounted adjacent one another on said base means, each said electric switch being offset from the pivot point of a corresponding tab and disposed beneath one side of one of said tabs so as to activated by said one side when said tab is pivoted toward said switch, the other side of said tab offset in the same direction from the pivot point as said one side being recessed so as not to activate an adjacent elastomeric switch when said tab is pivoted, thereby enabling said tabs and said elastomeric switches to be closely packed side by side without said tabs activating elastomeric switches of adjacent tabs.

17. The rocker switch assembly of claim 16, further comprising a second plurality of electric switches mounted adjacent one another on said base means, each said electric switch of said second plurality of electric switches being disposed beneath one side of one of said tabs in the same manner as said first plurality of switches, the side of said tab in one offset direction from said pivot point which is recessed being opposite the side of said tab in the other offset direction from said pivot point which is recessed.

18. The rocker switch assembly of claim 17 wherein said electric switches are elastomeric electric switches.

19. A rocker switch assembly, comprising:

(a) base means for supporting an elastomeric electric switch assembly;

(b) pivot means for mounted on said base means, said pivot means having first and second rocker bars extending away from said base means in the same direction, each said rocker bar having a pivot point protruding outwardly toward the other rocker bar, said pivot point having a substantially circular cross section and being truncated by a bevelled end, the portion of each said bevelled end further away from said base means also being furthest away from the bevelled end of said other pivot point;

(c) mounting means for attaching said pivot means to said base means;

(d) a C-shaped tab, having a face and two sides substantially perpendicular thereto, each side having an aperture therethrough large enough to receive one said pivot point, the sides of said tab being just far enough apart to fit between said rocker bars and sufficiently flexible that forcing the tab downwardly between said pivot points will force said sides toward one another until said apertures line up with and snap over said pivot points, thereby retaining said tab between said rocker bars; and (e) an elastomeric electric switch assembly mounted on said base means at a position between said tab and said base means, sandwiched between said pivot means and said base means, and held in place by said pivot means and said mounting means.

20. The rocker switch of claim 19 further comprising a lamp mounted on said base means centrally beneath said tab by releasable means for inserting said lamp through the aperture in said base means from the side thereof opposite said tab.

21. The rocker switch of claim 20, further comprising reflector means beneath said tab and disposed between said tab and said base means for directing light from said lamp through said tab.

22. The rocker switch of claim 21, wherein said pivot means and said reflector means are a single molded assembly.

23. The rocker switch of claim 19, wherein said base means and said pivot means include corresponding mounting holes therein and said mounting means comprises at least one rivet.

24. A rocker switch assembly, comprising:

(a) substantially flat base means for supporting an elastomeric electric switch;

(b) a tab;

(c) means for mounting said tab on said base means at a pivot point such that said tab pivots on an axis parallel to said base means;

(d) an elastomeric electric switch mounted adjacent said base means said elastomeric electric switch being disposed beneath said tab offset from said pivot axis and extending toward said tab from said base means so as to be actuated by said tab when said tab is pivoted toward said switch, said switch being actuated by sufficient compression thereof; and (e) an elastomeric bumper molded as one piece with said elastomeric electric switch and disposed between said base means and said tab on the same side of said pivot axis as said switch, said bumper being compressible by said tab but limiting the distance said tab can be pivoted toward said base means.

* * * * *

UNITED STATES PATENT AND TRADEMARK OFFICE

CERTIFICATE OF CORRECTION

PATENT NO. : 5,087,798

DATED : February 11, 1992

INVENTOR(S) : Rhode, et al.

It is certified that error appears in the above-identified patent and that said Letters Patent is hereby corrected as shown below:

Col. 5, Line 27 After "when" add --said--.

Col. 6, Line 24 Change "form" to --from--.

Col. 7, Line 13 Change "1" to --6--.

Col. 7, Line 42 After "so as to" add --be--.

Col. 8, Line 8 Change "further" to --furthest--.

Col. 8, Line 32 Change "through the" to --through an--.

Col. 2, Line 22 Change "through the tab, light from a lamp, also behind the tab," to --light from a lamp, also behind the tab, through the tab,--.

Col. 4, Line 19 Change "sheild" to --shield--.

Col. 4, Line 19 After "Each" add --light--.

Col. 4, Line 25 Change "sraddle" to --straddle--.

UNITED STATES PATENT AND TRADEMARK OFFICE

CERTIFICATE OF CORRECTION

PATENT NO. : 5,087,798

DATED : February 11, 1992

INVENTOR(S) : Rhode, et al

It is certified that error appears in the above-identified patent and that said Letters Patent is hereby corrected as shown below:

Col. 4, line 33 Change "sheilds" to --shields--.

Col. 4, Line 42 Change "ides" to --sides--.

Signed and Sealed this

Thirteenth Day of July, 1993

*Attest:*

Michael K. Kirk

MICHAEL K. KIRK

*Attesting Officer*

*Acting Commissioner of Patents and Trademarks*